US009635451B2

(12) United States Patent
Petersén

(10) Patent No.: US 9,635,451 B2
(45) Date of Patent: Apr. 25, 2017

(54) AUDIO ACCESSORY INCLUDING A HEADPHONE WITH SEPARATE SOCKETS

(75) Inventor: Erik Petersén, Nacka (SE)

(73) Assignee: Zound Industries International AB, Stockholm (SE)

( * ) Notice: Subject to any disclaimer, the term of this patent is extended or adjusted under 35 U.S.C. 154(b) by 43 days.

(21) Appl. No.: 14/345,464

(22) PCT Filed: Nov. 10, 2011

(86) PCT No.: PCT/SE2011/051352
§ 371 (c)(1),
(2), (4) Date: Mar. 18, 2014

(87) PCT Pub. No.: WO2013/070128
PCT Pub. Date: May 16, 2013

(65) Prior Publication Data
US 2014/0348340 A1 Nov. 27, 2014

(51) Int. Cl.
*H04R 1/10* (2006.01)
*H01R 31/06* (2006.01)
(Continued)

(52) U.S. Cl.
CPC ..... *H04R 1/1058* (2013.01); *H04R 1/1008* (2013.01); *H04R 1/1033* (2013.01);
(Continued)

(58) Field of Classification Search
CPC H04R 1/1058; H04R 1/1033; H04R 2201/10; H04R 2201/103;
(Continued)

(56) References Cited

U.S. PATENT DOCUMENTS 6,181,796 B1 1/2001 Johnson
6,310,959 B1 10/2001 Alexander
(Continued)

FOREIGN PATENT DOCUMENTS

CN 2359848 Y 1/2000
CN 2859970 Y 1/2007
(Continued)

OTHER PUBLICATIONS

International Search Report for PCT/SE2011/051352 dated Aug. 9, 2012.
(Continued)

*Primary Examiner* — Andrew L Sniezek
(74) *Attorney, Agent, or Firm* — Knobbe, Martens, Olson & Bear, LLP

(57) ABSTRACT

An audio accessory (1) having headphones (2) with at least one ear-cup (7) and a connection cable (3) for connecting the headphones to an audio device (10) includes a separate connection cable with connection plugs (4B, 5B) at each of its two ends, whereby connections plugs of different types are provided at the respective ends of the connection cable. Separate sockets (4A) of the different types are further provided in the headphones for connection to a respective connection plug at an end of the connection cable. Alternative uses for the audio accessory as well as headphones and a connection cable are also provided.

9 Claims, 4 Drawing Sheets

(51) Int. Cl.
*H01R 27/00* (2006.01)
*H01R 13/627* (2006.01)

(52) U.S. Cl.
CPC ..... *H01R 13/6271* (2013.01); *H01R 27/00* (2013.01); *H01R 31/06* (2013.01); *H04R 1/10* (2013.01); *H04R 2201/107* (2013.01); *H04R 2420/09* (2013.01)

(58) Field of Classification Search
CPC ..... H04R 2201/107; H04R 2420/09; H04R 5/033; H04R 1/1041; H04R 1/10; H01R 13/665; H01R 27/00; H01R 31/06; H01R 13/6271; H01R 13/70; H04M 1/6058
See application file for complete search history.

(56) References Cited

U.S. PATENT DOCUMENTS

| | | | | |
|---|---|---|---|---|
| 6,466,681 | B1 * | 10/2002 | Siska et al. | 381/372 |
| 6,600,826 | B1 | 7/2003 | Xavier | |
| 7,907,721 | B1 * | 3/2011 | Wurtz | H04M 1/6058 379/430 |
| 2002/0176330 | A1 * | 11/2002 | Ramonowski et al. | 369/30.36 |
| 2003/0022703 | A1 | 1/2003 | Reshefsky | |
| 2005/0002534 | A1 | 1/2005 | Aubauer et al. | |
| 2007/0025579 | A1 * | 2/2007 | Kolton | 381/384 |
| 2008/0152162 | A1 | 6/2008 | Bakalos et al. | |
| 2008/0166002 | A1 | 7/2008 | Amsel | |
| 2009/0010476 | A1 * | 1/2009 | Pan | 381/382 |
| 2009/0147982 | A1 | 6/2009 | Ashida et al. | |
| 2009/0180640 | A1 | 7/2009 | Ogawa | |
| 2009/0185707 | A1 | 7/2009 | Smith | |
| 2010/0111349 | A1 | 5/2010 | Devlas et al. | |
| 2010/0177924 | A1 | 7/2010 | Xu | |
| 2011/0111621 | A1 * | 5/2011 | Wakrat et al. | 439/502 |

FOREIGN PATENT DOCUMENTS

| | | | |
|---|---|---|---|
| CN | 101276963 | A | 10/2008 |
| CN | 101521320 | A | 9/2009 |
| EP | 2522155 | A1 | 11/2012 |
| JP | 10-155191 | | 6/1998 |
| JP | 10-155191 | A | 6/1998 |
| TW | M342670 | U | 10/2008 |
| WO | WO 2011/082404 | A1 | 7/2011 |
| WO | WO2011082404 | A1 | 7/2011 |

OTHER PUBLICATIONS

Supplementary European Search Report for EP 11 87 5355 dated Apr. 29, 2015.
Urbanears (brochure), published by Zound Industries, 2009.
Anonymous, Third Party Observation for application No. EP 20110728552, submitted Sep. 26, 2014 17:35.
Anonymous, Third Party Observation for application No. EP 20110728552, submitted Nov. 18, 2013 18:48.
Anonymous, Third Party Observation for application No. EP 20110728552, submitted Nov. 18, 2013 19:17.
Filing Receipt from USPTO in U.S. Appl. No. 61/292,132, mailed Jan. 15, 2010.
PCT Request Form in PCT/US2011/020057, submitted Jan. 3, 2011.
Urbanears, published by Zound Industries, 2009.
Office Action and Search Report in Chinese Application No. 201180074246.8, dated Aug. 26, 2016.

* cited by examiner

APP I

APP II

AUDIO ACCESSORY INCLUDING A HEADPHONE WITH SEPARATE SOCKETS

CROSS REFERENCE TO RELATED APPLICATIONS

This application is a U.S. National Phase Application of PCT International Application Number PCT/SE2011/051352, filed on Nov. 10, 2011, designating the United States of America and published in the English language. The disclosures of the above-referenced applications are hereby expressly incorporated by reference in their entireties.

TECHNICAL FIELD

The present invention generally concerns audio accessories and specifically relates to a headphone and connecting cable combination.

BACKGROUND

Different types of music equipment/audio devices frequently use different types of interconnectable male and female connectors of different sizes that are commonly jointly referred to as headphone connectors. Examples thereof are mobile phones and various types of portable AV devices, such as mp3 players, that in most cases are equipped with a 3.5 mm size female connector that is commonly named a minijack or mini socket and that is intended for receiving a corresponding 3.5 mm size male connector that is commonly named a miniplug or minijack plug. On the contrary, professional audio equipment frequently uses a bigger 6.3 mm size female connector, namely a jack/socket also commonly named a ¼ inch jack, a full-size jack or a phono jack that is intended for receiving a corresponding 6.3 mm size male connector/plug. It is often regarded as a problem that such different connector types/sizes are used in various types of audio devices and equipment. It has the effect that users frequently switching between e.g. portable devices and non-portable equipment are required to employ an adapter when connecting accessories, such as headphones thereto. Such adapters are often small in size and are therefore easily misplaced or even lost.

SUMMARY

A general object of the present invention is to provide a solution to the discussed problems.

In particular it is an object of the invention to suggest an audio accessory providing improved alternative connection options.

In particular it is another object of the invention to suggest an improved headphone for use in such an audio accessory.

In particular it is a further object of the invention to suggest an improved connection cable for use in such an audio accessory.

These and other objects are met by the invention as defined by the accompanying claims.

The invention generally relates to an audio accessory that includes a headphone with ear-cup and connection cable for connecting the headphone to an audio device. In a basic configuration the accessory includes a separate connection cable having connection plugs at each of its two ends. Different types of connections plugs are provided at respective ends of the connection cable and separate sockets of said different types are provided in the headphone for connection to a respective connection plug of the connection cable.

In accordance with further aspects of the invention a headphone and a connection cable, respectively, are suggested for use in the inventive audio accessory. In basic configurations thereof they are provided with separate female and male connectors of different types for connection to a mating male and female connector, respectively.

The basic audio accessory presents the advantages of:

- allowing easy, instant connection of the accessory to various types of audio systems;
- alternative connection variants integrated in the accessory;
- dispensing with the need for separate adapters; and thereby
- avoiding the risk of misplacing or losing such separate adapter items.

Preferred further developments of the basic inventive idea as well as embodiments thereof are specified in the dependent subclaims.

Advantages offered by the present invention, in addition to those described above, will be readily appreciated upon reading the below detailed description of embodiments of the invention.

BRIEF DESCRIPTION OF THE DRAWINGS

The invention and its further objects and advantages will be best understood by reference to the following description taken together with the accompanying drawings, in which.

DETAILED DESCRIPTION

Figure 1A:
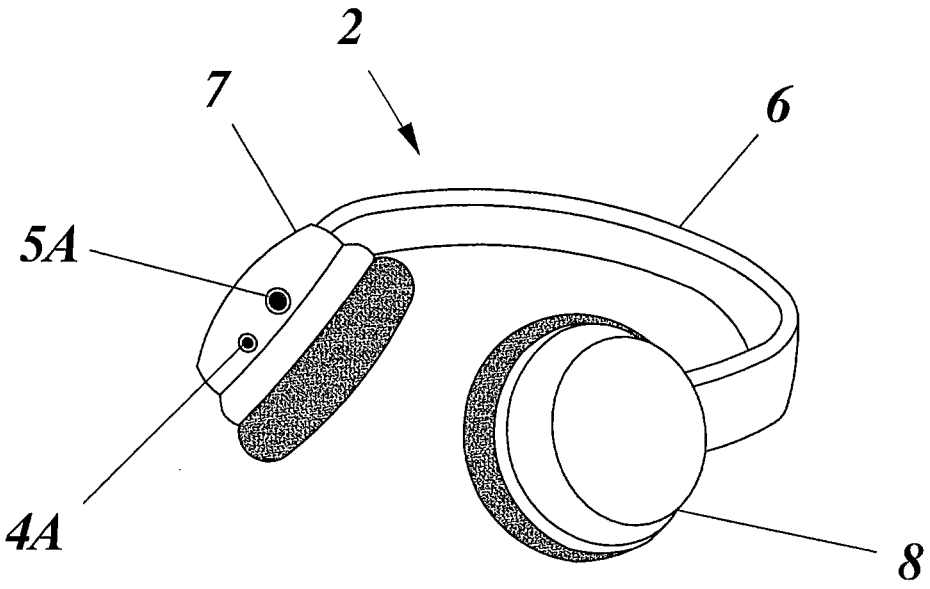
FIG. 1A is a schematical perspective view of a first embodiment of a headphone for use in the audio accessory of the invention.

The invention will be explained with reference to exemplifying embodiments of an audio accessory of the invention, including alternative uses thereof and alternative components included therein. These embodiments of the invention are described below and are illustrated in the accompanying drawing figures. They relate to an application of the inventive solution to an exemplary headphone and connection cable combination. It is emphasized that the illustrations are for the sole purpose of describing exemplary embodiments of the invention and are not intended to limit the invention to details or to any specific field of application thereof. The inventive solution may thus be used with and for other than the illustrated and described types of headphones and connection cables as well as audio devices and equipment that are all appropriate for such applications.

Expressions such as user equipment, audio devices and audio equipment shall therefore throughout this specification include any type of equipment in connection with which audio accessories including a headphone and a connection cable may be employed. It shall be realized that the invention covers the incorporation of such application related features and any combination of features disclosed herein.

It is stated throughout this specification that the headphones have a separate connection cable and it shall be emphasized from the beginning that this shall mean that the connection cable is not stationary or fixed to the headphone but is readily connectable and disconnectable in relation thereto. Parts of the specification also refer in general to interconnectable male and female connectors of different types and or standards. For the purposes of the invention this may theoretically include interconnectable connectors of any type that may be used for connecting audio devices or audio equipment to an accessory, such as headphones. At the present time such male and female connectors are mainly connector plugs (often referred to also as jack plugs, phono plugs etc.) and connector jacks (often referred to also as sockets or jack sockets) of the tip-ring-sleeve (TRS) or tip-sleeve (TS) type. Of such connectors a 3.5 mm size plug (often referred to as a standard minijack connector) and jack is the standard for music headphones and most other electronic devices/user equipment, such as mobile phones, whereas a 6.3 mm plug and jack is the standard for professional equipment, such as mixer tables or boards etc.

As was discussed in the introduction a common problem in association with connecting audio accessories to different types of audio devices as well as to audio equipment is the different types and/or standards of male and female connectors used therein. The invention attempts to overcome the disadvantages and problems encountered with the present commonly used solution of using separate small adapters that are often lost. The invention proposes a new approach for making this type of adapters superfluous in such applications. Specifically, the basic idea of the proposed solution is to provide an accessory including headphones and a separate connection cable having interconnectable connectors of two different types. This will provide the desired optional connection variants since the same cable may be used for connecting the headphones to most devices and equipment by simply turning the cable around.

Figure 1B:
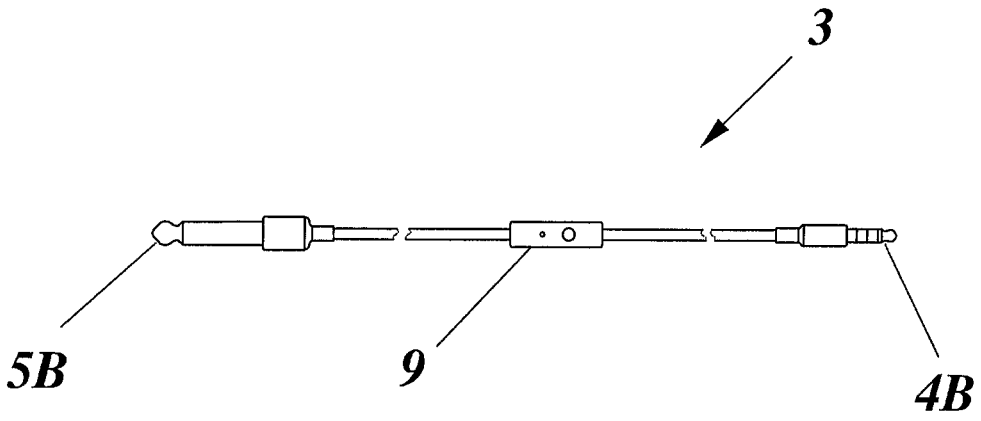
FIG. 1B is a schematical illustration of a connection cable for use in the audio accessory of the invention.

The invention will be explained below with reference to exemplifying schematical embodiments thereof that are illustrated in the accompanying drawing FIGS. 1-5. In FIGS. 1A-B is disclosed an exemplary embodiment of the inventive audio accessory to which the basic concept of the invention has been applied. In particular, FIGS. 1A-B schematically illustrate headphones 2 and a connection cable 3 being included in an audio accessory 1 (FIGS. 2 and 3) of the invention. The headphones 2 are of a basic type having two ear-cups 7, 8 supported by a headband 6. The connection cable 3 is a separate component used for connecting headphones 2 to user equipment 10, e.g. portable audio devices such as music players or mobile phones schematically indicated in FIG. 2, or alternatively to other audio equipment 11, such as a non-portable sound mixer board as schematically indicated in FIG. 3.

The connection cable illustrated in FIG. 1B has connection plugs 4B, 5B of mutually different types being provided at each of its two ends. In this embodiment one of the connection plugs 4B is a 3.5 mm (⅛ inch) size standard TRS or TS type male connector provided at one cable 3 end. The other connection plug 5B is a 6.3 mm (¼ inch) size standard TRS or TS type male connector provided at the opposite end of the cable 3. The headphones 2 illustrated in FIG. 1A have separate sockets 4A, 5A of said different types being provided in one of the ear-cups 7 for connection to a respective mating connection plug 4B and 5B, respectively, at an end of the connection cable 3. In this case one of the sockets 4A is thus a 3.5 mm (⅛ inch) size standard TRS or TS type female connector and the separate, slightly spaced other socket 5A is a 6.3 mm (¼ inch) size standard TRS or TS type female connector. In the illustrated embodiment the connection cable 3 is also equipped with a microphone 9 for allowing two-way communication, but it should be obvious that the inclusion of such a microphone is optional and does not form any actual part of the invention.

Figure 2:
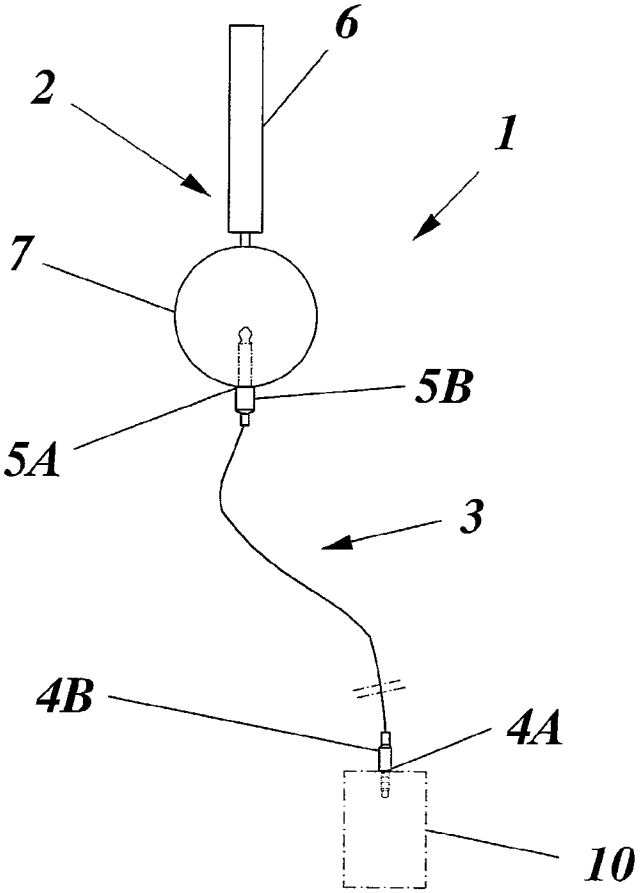
FIG. 2 is a schematical and partial view illustrating a first application I of the audio accessory of the invention.
Figure 3:
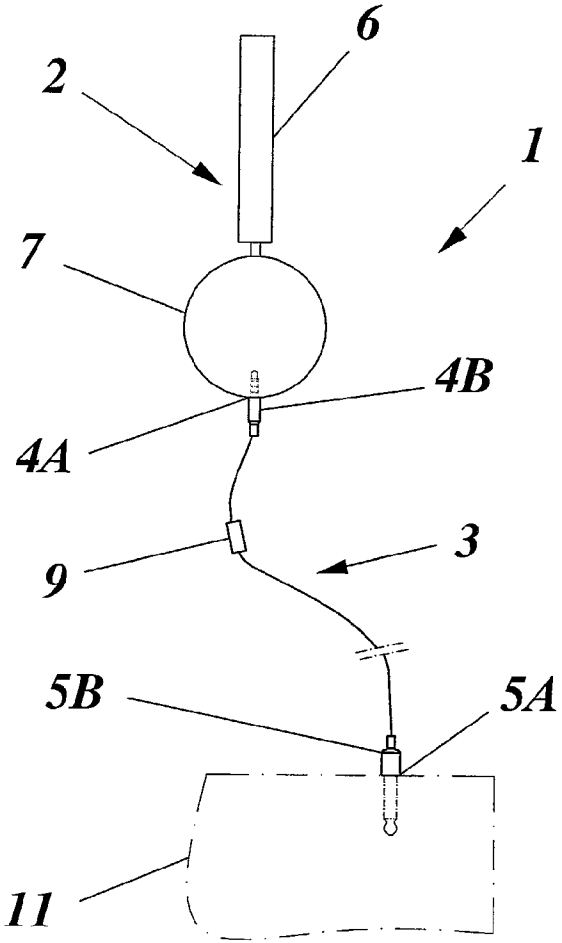
FIG. 3 is a schematical and partial view illustrating a second application II of the audio accessory of the invention.

With reference to FIGS. 2 and 3, the described embodiment of the audio accessory 1 of the invention may be used in two basic applications APP I and APP II. In the application APP I illustrated in FIG. 2 the connection cable 3 of FIG. 1B is connected with its 6.3 mm size connection plug 5B at one end of the connection cable 3 to a 6.3 mm size socket 5A of the headphones 2. The 3.5 mm size connection plug 4B at the other, opposite end of the connection cable 3 is connected to a mating 3.5 mm size socket 4A commonly found in predominantly portable user equipment 10, such as an mp3 music player or a mobile telephone for one- or two-way audio communication there between.

In an alternative application APP II of the inventive audio accessory 1 illustrated in FIG. 2, the cable 3 of FIG. 1B is simply turned around and connected with its 3.5 mm size connection plug 4B at one end of the connection cable 3 to the headphones 2. The 6.3 mm size connection plug 5B at the other end of the connection cable 3 is then connected to a mating 6.3 mm size socket 5A commonly found in predominantly stationary or non-portable audio devices 11, such as professional audio equipment. The switch between e.g. the described examples of applications may thus be performed without any small sized, easily misplaced or even lost adapters.

Figure 4:
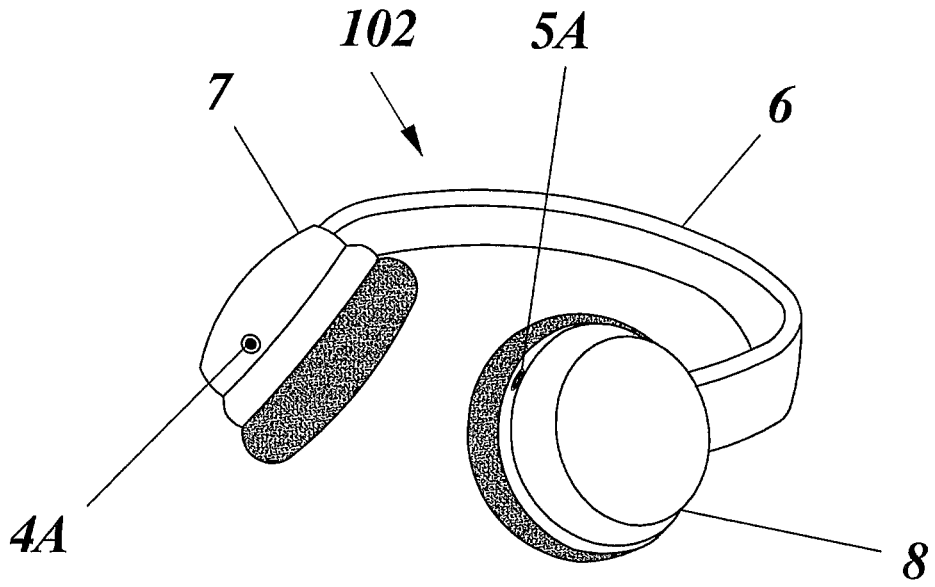
FIG. 4 is a schematical perspective view of a second embodiment of a headphone for use in the audio accessory of the invention.

In FIG. 4 is illustrated an alternative second embodiment of a pair of headphones 102 for inclusion in an audio accessory 1 of the invention, likewise in combination with a connection cable 3 as shown in FIG. 1B. Like before, the headphones 102 have two ear-cups 7, 8 supported by a headband 6 and two separate sockets 4A, 5A of said different types for connection to one each of the connection plugs 4B, 5B at the respective ends of the connection cable 3. However, in this embodiment is shown a variation of the first embodiment of FIG. 1A. Specifically, the separate sockets 4A, 5A are here provided in a separate ear-cup 7, 8, and specifically the left ear-cup of FIG. 4 is equipped with the 3.5 mm size socket 4A and the right ear-cup of FIG. 4 is equipped with the 6.3 mm size socket 5A.

Figure 5:
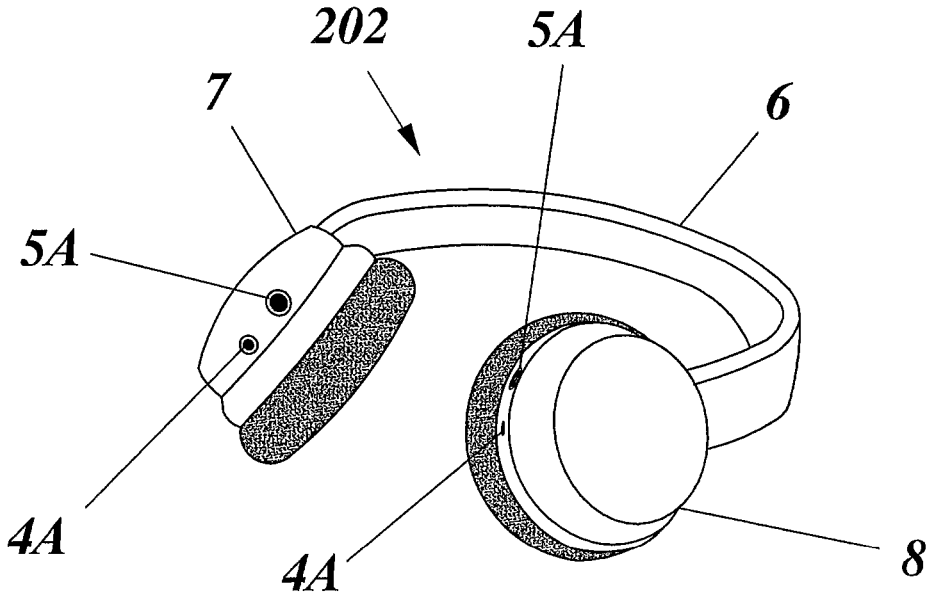
FIG. 5 is a schematical perspective view of a third embodiment of a headphone for use in the audio accessory of the invention.

In FIG. 5 is illustrated a further alternative third embodiment of a pair of headphones 202 for inclusion in an inventive audio accessory 1, likewise in combination with a connection cable 3 as shown in FIG. 1B. The headphones 202 likewise have two ear-cups 7, 8 supported by a headband 6 and separate sockets 4A, 5A of said different types for connection to one each of the connection plugs 4B, 5B at the respective ends of the connection cable 3. However, in this embodiment is shown a further variation of the first embodiment of FIG. 1A. Specifically, in this case the separate socket types 4A, 5A are paired in both ear-cups 7, 8, and specifically the left 7 as well as the right 8 ear-cup of FIG. 5 is equipped with both a 3.5 mm size socket 4A and a 6.3 mm size socket 5A.

Figure 6:
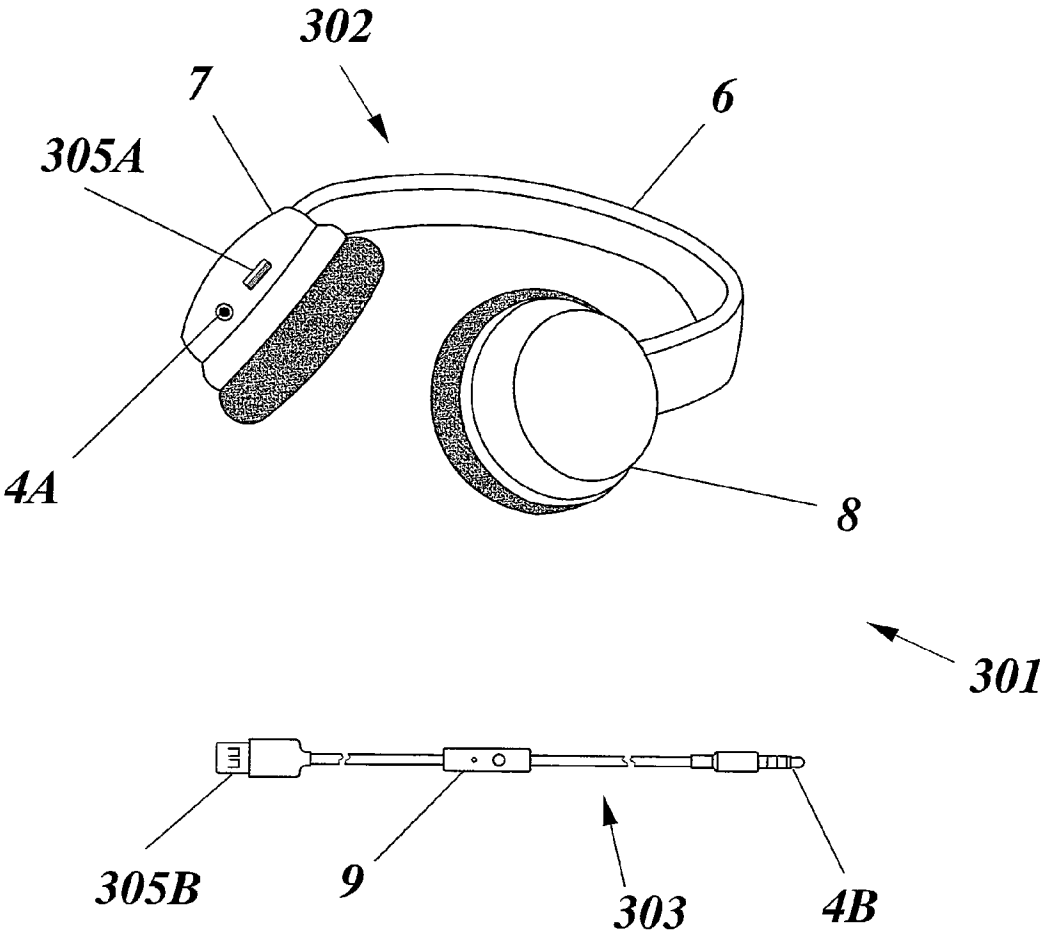
FIG. 6 is a schematical illustration of an alternative embodiment of an inventive audio accessory including variations of headphone and connection cable for use therein.

Finally, in FIG. 6 is illustrated an alternative embodiment of an audio accessory 301 of the invention. This variation is provided in order to exemplify the possible inclusion of other types of connectors in the headphones 302 and connection cable 303 of the audio accessory 301. In the given embodiment headphones 302 and connection cable 303 are basically the same as those of the previously described ones, except for the use of an alternative type of connector. Specifically, the left ear-cup 7 of the headphones 302 of FIG. 6 has a female connector/socket 4A of the earlier described 3.5 mm size standard TRS or TS type, and one end of the connection cable 303 has a mating male connector/plug 4B of the 3.5 mm size standard TRS or TS type. However, here the ear-cup 7 also has a second female connector 305A that is an universal serial bus (USB) type socket. The opposite end of the connection cable 303 has a mating male connector 305B being an USB type plug for connection to the USB socket 305A of the headphones 302 or alternatively to mating USB sockets that are becoming increasingly common in user equipment. It will also be clear that also this variation of the inventive audio accessory may be used in the previously described alternative modes or applications involving a simple turning around of the cable.

As stated above, the general object of the invention is to provide a solution that will make the presently commonly used separate small adapters superfluous in applications involving switching between different types of devices and equipment. This object is achieved by providing an accessory having the integrated adapter function to allow such switching without using separate additional adapters. For example, by providing the two different types of connectors in both the headphones and in the separate connection cable the switching between different types of devices may be performed by simply turning around the cable.

In alternative, but not specifically illustrated embodiments of the invention variations of the different illustrated parts of the inventive accessory may be employed without departing from the scope of the invention. An example of this is a use of the inventive solution to a headset type of accessory having only one ear-cup with two separate sockets being provided therein. Likewise, the connection cable of the accessory may or may not have the illustrated microphone. It shall also be emphasized that although the invention has been described and illustrated with specific reference to indicated applications thereof, the invention is in no way restricted to such applications. The basic principles of the invention may be used in association with other types of headphones and connection cables as well as audio devices/equipment and specifically also with other present and future types of connectors.

The invention has been described in connection with what is presently considered the most practical and preferred embodiments, but it is to be understood that the invention is not limited to the disclosed embodiments. The invention is therefore intended to cover various modifications and equivalent arrangements included within the spirit and scope of the appended claims.

The invention claimed is:

1. An audio accessory system comprising:

a headphone with at least one ear-cup;

a connection cable for connecting the headphone to an audio device, the audio device selected from different types of audio devices that have different output connection types, the connection cable having a first end and a second end opposite the first end, a first connection plug at the first end of the connection cable, and a second connection plug at the second end of the connection cable, wherein the first connection plug is a first type of connection plug and the second connection plug is a second type of connection plug, and wherein the first type of connection plug is different from the second type of connection plug; and two or more sockets corresponding to at least said different first and second connection plug types, the two or more sockets provided in at least one ear-cup of the headphone, wherein a first socket of the two or more sockets is configured for connection to a first plug of the connection cable having the connection plug type of the first connection plug, and wherein a second socket of the two or more sockets is configured for connection to a second plug of the connection cable having the connection plug type of the second connection plug, thereby allowing audio devices with different output connection types to be connected to the headphone.

2. The audio accessory system according to claim 1, wherein the at least one ear-cup of the headphone has the two or more sockets.

3. The audio accessory system according to claim 1, wherein the headphone includes two ear-cups supported by a head band, and wherein each of the two ear-cups has at least one of the two or more sockets.

4. The audio accessory system according to claim 1, wherein one of the two or more sockets and one of the first or second connection plugs is a 3.5 mm size standard tip-ring-sleeve (TRS) or tip-sleeve (TS) type connector, female and male, respectively, and wherein the other one of the two or more sockets and the other one of the first or second connection plugs is either a 6.3 mm size standard tip-ring-sleeve (TRS) or tip-sleeve (TS) type connector, female and male, respectively, or a standard universal serial bus (USB) type connector, female and male, respectively.

5. A method of using the audio accessory system of claim 4, comprising:

providing the connection cable having the 6.3 mm size or the universal serial bus (USB) type connection plug at the first or second end of the connection cable and the 3.5 mm size connection plug at the other of the first or second end of the connection cable;

connecting the 6.3 mm size or the universal serial bus (USB) type connection plug to the 6.3 mm size or the universal serial bus (USB) type socket of the headphone; and connecting the 3.5 mm size connection plug to the audio device, wherein the audio device is portable.

6. A method of using the audio accessory system of claim 4, comprising:

providing the connection cable having the 6.3 mm size or the universal serial bus (USB) type connection plug at the first or second end of the connection cable and the 3.5 mm size connection plug at the other of the first or second end of the connection cable;

connecting the 6.3 mm size or the universal serial bus (USB) type connection plug to the audio device, wherein the audio device is stationary or non-portable; and connecting the 3.5 mm size connection plug to the 3.5 mm size socket of the headphone.

7. The audio accessory system according to claim 1, wherein the headphone comprises two ear-cups supported by a headband, and wherein one of the two ear-cups has the two or more sockets.

8. The audio accessory system according to claim 7, wherein the first socket is a 3.5 mm size socket for connection to a 3.5 mm size connection plug and wherein the second socket is a 6.3 mm size socket or a universal serial bus (USB) socket for connection to, respectively, a 6.3 mm size connection plug or to an universal serial bus (USB) connection plug.

9. The audio accessory system according to claim 1, wherein, to connect the headphone with the audio device, either the first or second connection plug of the connection cable attaches to the headphone and the other of the first or second connection plug of the connection cable attaches to the audio device.

* * * * *